US005750328A

United States Patent [19]

Melpolder et al.

[11] Patent Number: 5,750,328

[45] Date of Patent: May 12, 1998

[54] THERMALLY PROCESSABLE IMAGING ELEMENT COMPRISING POLYMERIC MATTE PARTICLES

[75] Inventors: Sharon Marilyn Melpolder, Hilton; Dennis Edward Smith, Rochester; Christopher Edwin Wheeler, Fairport; John Leonard Muehlbauer, Rochester, all of N.Y.

[73] Assignee: Eastman Kodak Company, Rochester, N.Y.

[21] Appl. No.: 631,878

[22] Filed: Apr. 16, 1996

Related U.S. Application Data

[63] Continuation of Ser. No. 421,178, Apr. 13, 1995, abandoned.

[51] Int. Cl.[6] ..... G03C 1/498

[52] U.S. Cl. ..... 430/619; 430/523; 430/531; 430/536; 430/617; 430/950; 430/961

[58] Field of Search ..... 430/619, 617, 430/523, 965, 950, 531, 536, 961

[56] References Cited

U.S. PATENT DOCUMENTS 4,741,992 5/1988 Przezdziecki .
4,828,971 5/1989 Przezdziecki .
5,288,598 2/1994 Sterman et al. .
5,300,411 4/1994 Sterman et al. .
5,310,640 5/1994 Markin et al. .
5,378,577 1/1995 Smith et al. .
5,418,120 5/1995 Bauer et al. ..... 430/619

*Primary Examiner*—Thorl Chea
*Attorney, Agent, or Firm*—Alfred P. Lorenzo; Edith A. Rice

[57] ABSTRACT

Thermally processable imaging elements in which the image is formed by imagewise heating or by imagewise exposure to light followed by uniform heating are comprised of a support, a thermographic or photothermographic imaging layer, a protective overcoat layer and a backing layer and include in at least one layer thereof, polymeric matte particles comprising a polymeric core surrounded by a layer of colloidal inorganic particles. The polymeric matte particles provide enhanced image quality and improved processing characteristics with respect to adhesion, dusting and lack of haze.

23 Claims, No Drawings

THERMALLY PROCESSABLE IMAGING ELEMENT COMPRISING POLYMERIC MATTE PARTICLES

This is a Continuation of application Ser. No. 08/421,178, filed 13 Apr., 1995, now abandoned.

FIELD OF THE INVENTION

This invention relates in general to imaging elements and in particular to thermally processable imaging elements. More specifically, this invention relates to imaging elements which comprise a thermographic or photothermographic layer and which contain polymeric matte particles in at least one layer thereof.

BACKGROUND OF THE INVENTION

Thermally processable imaging elements, including films and papers, for producing images by thermal processing are well known. These elements include photothermographic elements in which an image is formed by imagewise exposure of the element to light followed by development by uniformly heating the element. These elements also include thermographic elements in which an image is formed by imagewise heating the element. Such elements are described in, for example, *Research Disclosure,* June 1978, Item No. 17029 and U.S. Pat. Nos. 3,080,254, 3,457,075 and 3,933,508.

The aforesaid thermally processable imaging elements are often provided with an overcoat layer and/or a backing layer, with the overcoat layer being the outermost layer on the side of the support on which the imaging layer is coated and the backing layer being the outermost layer on the opposite side of the support. Other layers which are advantageously incorporated in thermally processable imaging elements include subbing layers and barrier layers.

To be fully acceptable, a protective overcoat layer for such imaging elements should: (a) provide resistance to deformation of the layers of the element during thermal processing, (b) prevent or reduce loss of volatile components in the element during thermal processing, (c) reduce or prevent transfer of essential imaging components from one or more of the layers of the element into the overcoat layer during manufacture of the element or during storage of the element prior to imaging and thermal processing, (d) enable satisfactory adhesion of the overcoat to a contiguous layer of the element, (e) be free from cracking and undesired marking, such as abrasion marking, during manufacture, storage, and processing of the element, (f) provide adequate conveyance characteristics during manufacture and processing of the element, (g) not allow blocking, adhering or slippage of the element during manufacture, storage, or processing and (h) not induce undesirable sensitometric effects in the element during manufacture, storage or processing.

A backing layer also serves several important functions which improve the overall performance of thermally processable imaging elements. For example, a backing layer serves to improve conveyance, reduce static electricity and eliminate formation of Newton Rings.

A particularly preferred overcoat for thermally processable imaging elements is an overcoat comprising poly(silicic acid) as described in U.S. Pat. No. 4,741,992, issued May 3, 1988. Advantageously, water-soluble hydroxyl-containing monomers or polymers are incorporated in the overcoat layer together with the poly(silicic acid). The combination of poly(silicic acid) and a water-soluble hydroxyl-containing monomer or polymer that is compatible with the poly(silicic acid) is also useful in a backing layer on the side of the support opposite to the imaging layer as described in U.S. Pat. No. 4,828,971, issued May 9, 1989.

U.S. Pat. No. 4,828,971 explains the requirements for backing layers in thermally processable imaging elements. It points out that an optimum backing layer must:

(a) provide adequate conveyance characteristics during manufacturing steps, (b) provide resistance to deformation of the element during thermal processing, (c) enable satisfactory adhesion of the backing layer to the support of the element without undesired removal during thermal processing, (d) be free from cracking and undesired marking, such as abrasion marking during manufacture, storage and processing of the element, (e) reduce static electricity effects during manufacture and (f) not provide undesired sensitometric effects in the element during manufacture, storage or processing.

With photothermographic elements, it is usually necessary to produce a "duplicate image" of that on the imaging element for low cost dissemination of the image. The duplication process is typically a "contact printing" process where intimate contact between the photothermographic imaging element and the duplication imaging element is essential. Successful duplication of either continuous rolls or cut sheets is dependent on adequate conveyance of the imaging element through the duplication equipment without the occurrence of slippage or sticking of the protective overcoat layer of the photothermographic imaging element in relation to any of (1) the duplication equipment, (2) the duplication imaging element or (3) the backing layer of subsequent portions of the photothermographic imaging element (adjacent convolutions of the photothermographic imaging element if in a continuous roll or adjacent "cut sheets" in a stacking configuration). The latter of these phenomena is often referred to as "blocking".

The addition of matte particles in the protective overcoat layer is commonly used to prevent adhering or "blocking" between the protective overcoat layer and adjacent backing layer with which it is in intimate contact during manufacture, storage, processing and photo duplication. Furthermore, the matte particles are necessary to impart anti-frictional characteristics to the protective overcoat layer to achieve proper conveyance without sticking, blocking or slippage during the duplication process. The amount and particle size must be controlled as the wrong particle size and/or amount can cause both conveyance and duplicate image quality problems.

The photothermographic imaging element is typically viewed at magnification ratios as high as 100×. The matte particle in the protective overcoat layer, if too large, can negatively alter the appearance of the image in the photothermographic imaging element layer when viewed at magnification larger than 1×. This altered image can further be transferred through the duplication process as well as a tertiary transformation of the image to paper through contact printing, electrophotographic processes, thermal printing or similar processes.

As described in U.S. Pat. Nos. 4,828,971 and 5,310,640, matte particles that are commonly used in photothermographic imaging elements include inorganic matting agents such as silica and organic matting agents such as polymethylmethacrylate beads. The use of these materials in photothermographic imaging elements suffers from a number of disadvantages. Thus, for example, their average particle size cannot be controlled to a sufficiently narrow size distribution, individual particles of nominal size <2 micrometers can agglomerate to sizes >5 micrometers and hence become visible to the eye and alter the photothermographic image when viewed at magnifications greater than 1×. Furthermore these agglomerated particles can render it essentially impossible to precisely meter the right quantity of matte particles to the coating formulation, resulting in inconsistent conveyance, blocking and imaging properties. These disadvantages can result in increased product waste due to unacceptable image quality and increased manufacturing costs resulting from constant filter plugging, monitoring, and cleaning of the photothermographic manufacturing equipment.

It is toward the objective of providing improved thermally processable imaging elements, containing matte particles which do not suffer from the above disadvantages, that this invention is directed.

SUMMARY OF THE INVENTION

In accordance with this invention, a thermally processable imaging element is comprised of:

(1) a support;

(2) a thermographic or photothermographic imaging layer on one side of the support;

(3) a protective overcoat layer which is an outermost layer on the same side of the support as the imaging layer; and (4) a backing layer which is an outermost layer located on the side of the support opposite to the imaging layer; wherein the thermally processable imaging element comprises polymeric matte particles in at least one layer thereof, the polymeric matte particles comprising a polymeric core surrounded by a layer of colloidal inorganic particles.

In a preferred embodiment of the invention, the polymeric matte particles comprising a polymeric core surrounded by a layer of colloidal inorganic particles have a mean diameter in the range of from about 0.5 to about 5 micrometers and are incorporated in the protective overcoat layer in an amount of from about 10 to about 200 milligrams per square meter. Such particles have been found to provide improved image quality while effectively avoiding problems such as blocking.

DESCRIPTION OF THE PREFERRED EMBODIMENTS

The thermally processable imaging element of this invention can be of the type in which an image is formed by imagewise heating of the element or of the type in which an image is formed by imagewise exposure to light followed by uniform heating of the element. The latter type of element is commonly referred to as a photothermographic element.

Typical photothermographic imaging elements within the scope of this invention comprise at least one imaging layer containing in reactive association in a binder, preferably a binder comprising hydroxyl groups, (a) photographic silver halide prepared in situ and/or ex situ, (b) an image-forming combination comprising (i) an organic silver salt oxidizing agent, preferably a silver salt of a long chain fatty acid, such as silver behenate, with (ii) a reducing agent for the organic silver salt oxidizing agent, preferably a phenolic reducing agent, and (c) an optional toning agent. References describing such imaging elements include, for example, U.S. Pat. Nos. 3,457,075; 4,459,350; 4,264,725 and 4,741,992 and *Research Disclosure,* June 1978, Item No. 17029.

The photothermographic element comprises a photosensitive component that consists essentially of photographic silver halide. In the photothermographic material it is believed that the latent image silver from the silver halide acts as a catalyst for the described image-forming combination upon processing. A preferred concentration of photographic silver halide is within the range of 0.01 to 10 moles of photographic silver halide per mole of silver behenate in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, *Research Disclosure,* December 1978, Item No. 17029 and *Research Disclosure,* June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 100 moles of organic silver salt oxidizing agent per mole of silver halide in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and *Research Disclosure,* June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,321. Examples of useful sulfonamidophenol reducing agents are 2,6-dichloro-4-benzene-sulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt and the particular oxidizing agent.

The photothermographic element preferably comprises a toning agent, also known as an activator-toner or toner-accelerator. Combinations of toning agents are also useful in the photothermographic element. Examples of useful toning agents and toning agent combinations are described in, for example, *Research Disclosure,* June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2 H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly (vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly(methylmethacrylate), poly (vinylpyrrolidone), ethyl cellulose, polystyrene, poly (vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure,* December 1978, Item No. 17643 and *Research Disclosure,* June 1978, Item No. 17029.

The thermally processable element can comprise a variety of supports. Examples of useful supports are poly (vinylacetal) film, polystyrene film, poly (ethyleneterephthalate) film, poly(ethylene naphthalate) film, polycarbonate film, and related films and resinous materials, as well as paper, glass, metal, and other supports that withstand the thermal processing temperatures.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, *Research Disclosure,* June 1978, Item No. 17029 and *Research Disclosure,* December 1978, Item No. 17643.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 140° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the thermally processable element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

It is necessary that the components of the imaging combination be "in association" with each other in order to produce the desired image. The term "in association" herein means that in the photothermographic element the photographic silver halide and the image forming combination are in a location with respect to each other that enables the desired processing and forms a useful image.

As hereinabove described, the thermally processable imaging element of this invention includes, in at least one layer thereof, polymeric matte particles comprising a polymeric core surrounded by a layer of colloidal inorganic particles.

The polymeric matte particles utilized in this invention can be incorporated in any layer of the thermally processable element but are preferably included in a protective overcoat layer which is an outermost layer on the same side of the support as the imaging layer and are preferably disposed so that they protrude slightly above the surface of such overcoat layer.

The polymeric matte particles utilized in this invention preferably have a mean diameter in the range of from about 0.5 to about 5 micrometers, more preferably in the range of from about 0.5 to about 2 micrometers and most preferably in the range of from about 0.6 to about 1 micrometers. They are preferably utilized in an amount of from about 10 to about 200 $mg/m^2$ and more preferably from about 20 to about 70 $mg/m^2$.

The polymeric matte particles which are useful in this invention are described in detail in Smith et al, U.S. Pat. No. 5,378,577, issued Jan. 3, 1995, the disclosure of which is incorporated herein by reference in its entirety.

As described in the '577 patent, any suitable colloidal inorganic particles can be used to form the particulate layer on the polymeric core, such as, for example, silica, alumina, alumina-silica, tin oxide, titanium dioxide, zinc oxide and the like. Colloidal silica is preferred for several reasons including ease of preparation of the coated polymeric particles and narrow size distribution. For the purpose of simplification of the presentation of this invention, throughout the remainder of this specification colloidal silica will be used as the "colloidal inorganic particles" surrounding the polymeric core material, however, it should be understood that any of the colloidal inorganic particles may be employed. Any suitable polymeric material or mixture of polymeric materials capable of being formed into particles having the desired size may be employed in the practice of this invention to prepare matte particles for use in thermally processable elements, such as, for example, olefin homopolymers and copolymers, such as polyethylene, polypropylene, polyisobutylene, polyisopentylene and the like; polyfluoroolefins such as polytetrafluoroethylene, polyvinylidene fluoride and the like, polyamides, such as, polyhexamethylene adipamide, polyhexamethylene sebacamide and polycaprolactam and the like; acrylic resins, such as polymethylmethacrylate, polyacrylonitrile, polymethylacrylate, polyethylmethacrylate and styrene-methylmethacrylate or ethylene-methyl acrylate copolymers, ethylene-ethyl acrylate copolymers, ethylene-ethyl methacrylate copolymers, polystyrene and copolymers of-styrene with unsaturated monomers mentioned below, polyvinyltoluene, cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl alcohol, polyvinyl acetal, ethylene-vinyl acetate copolymers, ethylene-vinyl alcohol copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers and polyoxy-methylene, polycondensation polymers, such as, polyesters, including polyethylene terephthalate, polybutylene terephthalate, polyurethanes and polycarbonates. In some applications for thermally processable elements it is desirable to select a polymer or copolymer that has an index of refraction that substantially matches the index of refraction of the material of the layer in which it is coated.

If desired, a suitable crosslinking monomer may be used in forming polymer particles by polymerizing a monomer or monomers within droplets in accordance with this invention to thereby modify the polymeric particle and produce particularly desired properties. Typical crosslinking monomers are aromatic divinyl compounds such as divinylbenzene, divinylnaphthalene or derivatives thereof; diethylene carboxylate esters and amides such as diethylene glycol bis (methacrylate), diethylene glycol diacrylate, and other divinyl compounds such as divinyl sulfide or divinyl sulfone compounds. Styrene, vinyl toluene or methyl methacrylate, as homopolymers, copolymers or crosslinked polymers, are preferred. Vinyl toluene crosslinked with divinylbenzene is especially preferred.

As indicated above, the most preferred mean particle diameter of the polymeric particles is from about 0.6 to about 1 micrometer. The mean diameter is defined as the mean of the volume distribution.

Any suitable method of preparing polymeric particles surrounded by a layer of colloidal silica may be used to prepare the matte bead particles for use in accordance with this invention. For example, suitably sized polymeric particles may be passed through a fluidized bed or heated moving or rotating fluidized bed of colloidal silica particles, the temperature of the bed being such as to soften the surface of the polymeric particles thereby causing the colloidal silica particles to adhere to the polymer particle surface. Another technique suitable for preparing polymer particles surrounded by a layer of colloidal silica is to spray dry the particles from a solution of the polymeric material in a suitable solvent and then before the polymer particles solidify completely, pass the particles through a zone of colloidal silica wherein the coating of the particles with a layer of the colloidal silica takes place. Another method to coat the polymer particles with a layer of colloidal silica is by Mechano Fusion.

A still further method of preparing the matte particles in accordance with this invention is by limited coalescence.

This method includes the "suspension polymerization" technique and the "polymer suspension" technique. In the "suspension polymerization" technique, a polymerizable monomer or monomers are added to an aqueous medium containing a particulate suspension of colloidal silica to form a discontinuous (oil droplets) phase in a continuous (water) phase. The mixture is subjected to shearing forces by agitation, homogenization and the like to reduce the size of the droplets. After shearing is stopped an equilibrium is reached with respect to the size of the droplets as a result of the stabilizing action of the colloidal silica stabilizer in coating the surface of the droplets and then polymerization is completed to form an aqueous suspension of polymer particles in an aqueous phase having a uniform layer thereon of colloidal silica. This process is described in U.S. Pat. Nos. 2,932,629 and 4,148,741 incorporated herein by reference.

In the "polymer suspension" technique, a suitable polymer is dissolved in a solvent and this solution is dispersed as fine water-immiscible liquid droplets in an aqueous solution that contains colloidal silica as a stabilizer. Equilibrium is reached and the size of the droplets is stabilized by the action of the colloidal silica coating the surface of the droplets. The solvent is removed from the droplets by evaporation or other suitable technique resulting in polymeric particles having a uniform coating thereon of colloidal silica. This process is further described in U.S. Pat. No. 4,833,060 issued May 23, 1989, assigned to the same assignee as this application and herein incorporated by reference.

In practicing this invention, using the suspension polymerization technique, any suitable monomer or monomers may be employed such as, for example, styrene, vinyl toluene, p-chlorostyrene; vinyl naphthalene; ethylenically unsaturated mono olefins such as ethylene, propylene, butylene and isobutylene; vinyl halides such as vinyl chloride, vinyl bromide, vinyl fluoride, vinyl acetate, vinyl propionate, vinyl benzoate and vinyl butyrate; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alphachloroacrylate, methyl methacrylate, ethyl methacrylate and butyl methacrylate; acrylonitrile, methacrylonitrile, acrylamide, vinyl ethers such as vinyl methyl ether, vinyl isobutyl ether and vinyl ethyl ether; vinyl ketones such as vinyl methylketone, vinyl hexyl ketone and methyl isopropyl ketone; vinylidene halides such as vinylidene chloride and vinylidene chlorofluoride; and N-vinyl compounds such as N-vinyl pyrrole, N-vinyl carbazole, N-vinyl indole and N-vinyl pyrrolidone, divinyl benzene, ethylene glycol dimethacrylate, mixtures thereof; and the like.

In the suspension polymerization technique, other addenda are added to the monomer droplets and to the aqueous phase of the mass in order to bring about the desired result including initiators, promoters and the like which are more particularly disclosed in U.S. Pat. Nos. 2,932,629 and 4,148,741, both of which are incorporated herein in their entirety.

Useful solvents for the polymer suspension process are those that dissolve the polymer, which are immiscible with water and which are readily removed from the polymer droplets such as, for example, chloromethane, dichloromethane, ethylacetate, vinyl chloride, methyl ethyl ketone, trichloromethane, carbon tetrachloride, ethylene chloride, trichloroethane, toluene, xylene, cyclohexanone, 2-nitropropane and the like. A particularly useful solvent is dichloromethane because it is a good solvent for many polymers while at the same time, it is immiscible with water. Further, its volatility is such that it can be readily removed from the discontinuous phase droplets by evaporation.

The quantities of the various ingredients and their relationship to each other in the polymer suspension process can vary over wide ranges, however, it has generally been found that the ratio of the polymer to the solvent should vary in an amount of from about 1 to about 80% by weight of the combined weight of the polymer and the solvent and that the combined weight of the polymer and the solvent should vary with respect to the quantity of water employed in an amount of from about 25 to about 50% by weight. The size and quantity of the colloidal silica stabilizer depends upon the size of the particles of the colloidal silica and also upon the size of the polymer droplet particles desired. Thus, as the size of the polymer/solvent droplets are made smaller by high shear agitation, the quantity of solid colloidal stabilizer is varied to prevent uncontrolled coalescence of the droplets and to achieve uniform size and narrow size distribution of the polymer particles that result. The suspension polymerization technique and the polymer suspension technique herein described are the preferred methods of preparing the matte particles having a uniform layer of colloidal silica thereon for use in the preparation of thermally processable elements in accordance with this invention. These techniques provide particles having a predetermined average diameter anywhere within the range of from 0.5 micrometer to about 150 micrometers with a very narrow size distribution. The coefficient of variation (ratio of the standard deviation) to the average diameter, as described in U.S. Pat. No. 2,932,629, referenced previously herein, are normally in the range of about 15 to 35%.

When making matte particles of this invention, it is sometimes desirable to incorporate a non-reactive hydrophobic additive. This method is particularly suitable for making polymeric particles where uniform size and size distribution, with minimal oversized particles, are a consideration such as photothermographic matte beads.

The nonreactive compound will have a solubility in water less than that of the ethylenically unsaturated monomer. Where more than one ethylenically unsaturated monomer is employed, as in the preparation of a copolymer, the nonreactive compound will have a solubility in water less than that of the least soluble monomer. Stated another way, the nonreactive compound is more hydrophobic than the most hydrophobic ethylenically unsaturated monomer in the monomer droplets. A convenient manner of defining the hydrophobicity of materials is by calculating the log of the octanol/water partition coefficient ($\log P_{(calc)}$), the higher the numerical value, the more hydrophobic is the compound. Thus, the nonreactive compound will have a $\log P_{(calc)}$ greater than the $\log P_{(calc)}$ of the most hydrophobic ethylenically unsaturated monomer present. Preferably, the difference in $\log P_{(calc)}$ of the monomer and the nonreactive compound (D $\log P_{(calc)}$) should be at least 1 and most preferably at least 3 to achieve the most uniform particle size with the lowest values for particle size distribution.

In accordance with the invention, the nonreactive hydrophobic compound is present in the ethylenically unsaturated monomer droplets (discontinuous phase); however, the hydrophobic compound can be added initially either to the monomer phase before addition of the water or continuous phase, which is preferred, or to the water phase either before or after the two phases are added together but before the mixture is subjected to shearing forces. While not being bound by a particular theory or mechanism, it is believed that oversized particles are formed by diffusion of monomers prior to or during polymerization and that the hydrophobic additive prevents or reduces the rate of diffusion, and thereby reduces the formation of larger particles As indicated above, the nonreactive compound is more hydrophobic than the monomer and has a higher $\log P_{(calc)}$ than the monomer. $\log P_{(calc)}$ is the logarithm of the value of the octanol/water partition coefficient (P) of the compound calculated using MedChem, version 3.54, a software package available from the Medicinal Chemistry Project, Pomona College, Claremont, Calif. $\log P_{(calc)}$ is a parameter which is highly correlated with measured water solubility for compounds spanning a wide range of hydrophobicity. $\log P_{(calc)}$ is a useful means to characterize the hydrophobicity of compounds. The nonreactive compounds used in this invention are either liquid or oil soluble solids and have a $\log P_{(calc)}$ greater than any of the ethylenically unsaturated monomers present. Suitable nonreactive, hydrophobic compounds are those selected from the following classes of compounds:

I. Saturated and unsaturated hydrocarbons and halogenated hydrocarbons, including alkanes, alkenes, alkyl and alkenyl halides, alkyl and alkenyl aromatic compounds, and halogenated alkyl and alkenyl aromatic compounds, especially those having a $\log P_{calc}$ greater than about 3, II. alcohols, ethers, and carboxylic acids containing a total of about 10 or more carbon atoms, especially those having a $\log P_{calc}$ greater than about 3, III. esters of saturated, unsaturated, or aromatic carboxylic acids containing a total of about 10 or more carbon atoms, especially those having a $\log P_{calc}$ greater than about 3, IV. amides of carboxylic acids having a total of 10 or more carbon atoms, especially those having a $\log P_{calc}$ greater than about 3, V. esters and amides of phosphorus- and sulfur-containing acids having a $\log P_{calc}$ greater than about 3, and other compounds of similar hydrophobicity.

Compounds of Class I include: straight or branched chain alkanes such as, for example, hexane, octane, decane, dodecane, tetradecane, hexadecane, octadecane, 2,2,6,6,9,9-hexamethyldodecane, eicosane, or triacontane; alkenes such as, for example, heptene, octene, or octadecene; substituted aromatic compounds such as, for example, octylbenzene, nonylbenzene, dodecylbenzene, or 1,1,3,3-tetramethylbutylbenzene; haloalkanes such as, for example, heptyl chloride, octyl chloride, 1,1,1-trichlorohexane, hexyl bromide, 1,11-dibromoundecane, and halogenated alkyl aromatic compounds such as, for example, p-chlorohexylbenzene and the like.

Compounds of Class II include: decanol, undecanol, dodecanol, hexadecanol, stearyl alcohol, oleyl alcohol, eicosanol, di-t-amyl phenol, p-dodecylphenol, and the like; lauric acid, tetradecanoic acid, stearic acid, oleic acid, and the like; methyldodecylether, dihexyl ether, phenoxytoluene, and phenyldodecyl ether; and the like.

Compounds of Class III include: methyl laurate, butyl laurate, methyl oleate, butyl oleate, methyl stearate, isopropyl palmitate, isopropyl stearate, tributyl citrate, acetyl tributyl citrate, 3-(4-hydroxy-3,5-di-t-butylphenyl)propionic octadecyl ester (commercially available under the trademark Irganox 1076), 2-ethylhexyl-p-hydroxylbenzoate, phenethyl benzoate, dibutyl phthalate, dioctyl phthalate, dioctyl terephthalate, bis(2-ethylhexyl) phthalate, butyl benzyl phthalate, diphenyl phthalate, dibutyl sebacate, didecyl succinate, and bis(2-ethylhexyl) azelate and the like.

Compounds of Class IV include: lauramide, N-methyllauramide, N,N-dimethyllauramide, N,N-dibutyllauramide, N-decyl-N-methylacetamide, and N-oleylphthalimide and the like.

Compounds of Class V include, for example, sulfates, sulfonates, sulfonamides, sulfoxides, phosphates, phosphonates, phosphinates, phosphites, or phosphine oxides. Particular examples include diesters of sulfuric acid, such as, for example, dihexylsulfate, didecylsulfate, and didodecylsulfate; esters of various alkyl sulfonic acids including, for example, methyl decanesulfonate, octyl dodecanesulfonate, and octyl p-toluenesulfonate; sulfoxides, including, for example, bis(2-ethylhexyl) sulfodxide; and sulfonamides, including, for example, N-(2-ethylhexyl)-p-toluenesulfonamide, N-hexadecyl-p-toluenesulfonamide, and N-methyl-N-dodecyl-p-toluenesulfonamide. Phosphorus-containing compounds include, for example, triesters of phosphoric acid such as, for example, triphenyl phosphate, tritolylphosphate, trihexylphosphate, and tris(2-ethylhexyl)phosphate; various phosphonic acid esters, such as, for example, dihexyl hexylphosphonate, and dihexyl phenylphosphonate; phosphite esters such as tritolylphosphite, and phosphine oxides such as trioctylphosphine oxide.

Representatives compounds are given below, along with their $\log P_{calc}$ value, calculated using the above-mentioned MedChem software package (version 3.54). This software package is well-known and accepted in the chemical and pharmaceutical industries.

| Nonreactive Compound | $\log P_{calc}$ |
|---|---|
| hexane | 3.87 |
| octane | 4.93 |
| decane | 5.98 |
| dodecane | 7.04 |
| hexadecane | 9.16 |
| dimethylphthalate | 1.36 |
| dibutylphthalate | 4.69 |
| bis (2-ethylhexyl)phthalate | 8.66 |
| dioctylphthalate | 8.92 |
| tritolyphosphate | 6.58 |
| tris (2-ethylhexyl)phosphate | 9.49 |
| dodecylbenzene | 8.61 |
| bis (2-ethylhexyl) azelate | 9.20 |
| trioctylphosphine oxide | 9.74 |
| dinonyl phthalate | 9.98 |
| didecyl phthalate | 11.04 |
| didodecyl phthalate | 13.15 |
| 3-(4-hydroxy-3, 5-di-t-butylphenyl) -propionic acid, octadecyl ester | 14.07 |
| trioctyl amine | 10.76 |
| **Monomer** | **$\log P_{calc}$** |
| acrylic acid | 0.16 |
| isopropyl acrylamide | 0.20 |
| b-(hydroxyethyl) methacrylate | 0.25 |
| divinyl benzene | 3.59 |
| vinyl acetate | 0.59 |
| methyl acrylate | 0.75 |
| methyl methacrylate | 1.06 |
| ethyl acrylate | 1.28 |
| ethyl methacrylate | 1.59 |
| butyl acrylate | 2.33 |
| butyl methacrylate | 2.64 |
| styrene | 2.89 |
| divinyl benzene | 3.59 |
| mixture of vinyl toluenes | 3.37 |
| 2-ethylhexyl acrylate | 4.32 |
| 2-ethylhexyl methacrylate | 4.62 |
| t-butylstyrene | 4.70 |

The hydrophobic compound is employed in an amount of at least about 0.01 to about 5, preferably at least about 0.05 to about 4 and most preferably at least about 0.5 to about 3 percent by weight based on the weight of the monomer. Hexadecane is particularly preferred.

A wide variety of materials can be used to prepare a backing layer that is compatible with the requirements of thermally processable imaging elements. The backing layer should be transparent and colorless and should not adversely affect sensitometric characteristics of the photothermographic element such as minimum density, maximum density and photographic speed. Useful backing layers include those comprised of poly(silicic acid) and a water-soluble hydroxyl containing monomer or polymer that is compatible with poly(silicic acid) as described in U.S. Pat. No. 4,828,971. A combination of poly(silicic acid) and poly(vinyl alcohol) is particularly useful. Other useful backing layers include those formed from polymethylmethacrylate, acrylamide polymers, cellulose acetate, crosslinked polyvinyl alcohol, terpolymers of acrylonitrile, vinylidene chloride, and 2-(methacryloyloxy)ethyl-trimethylammonium methosulfate, crosslinked gelatin, polyesters and polyurethanes.

The backing layer preferably has a glass transition temperature (Tg) of greater than 50° C., more preferably greater than 100° C., and a surface roughness such that the Roughness Average (Ra) value is greater than 0.8, more preferably greater than 1.2, and most preferably greater than 1.5.

As described in U.S. Pat. No. 4,828,971, the Roughness Average (Ra) is the arithmetic average of all departures of the roughness profile from the mean line.

As described in Markin et al, U.S. Pat. No. 5,310,640, issued May 10, 1994, particularly advantageous thermally processable imaging elements include both a backing layer and an electroconductive layer which serves as an antistatic layer.

The overcoat layer utilized in the thermally processable imaging elements of this invention performs several important functions as hereinabove described. It can be composed of hydrophilic colloids such as gelatin or poly(vinyl alcohol) but is preferably composed of poly(silicic acid) and a water-soluble hydroxyl-containing monomer or polymer as described in U.S. Pat. No. 4,741,992, issued May 3, 1988.

Preparation of polymeric matte particles having a polymeric core surrounded by a layer of colloidal inorganic particles is illustrated by the following preparations numbered 1 to 7. Preparation of polymeric matte particles used herein as a control is described in preparation 8.

Preparation 1

To 2570 g distilled water is added 26.6 g phthalic acid monopotassium salt, 10.5 g 0.1N hydrochloric acid, 20.14 g poly(N-methylaminoethanol-co-adipate) and 287 g of colloidal silica sold by DuPont under the trade designation Ludox TM. In a separate container is added 1,456 g vinyl toluene, 364 g divinylbenzene, 18 g hexadecane, and 27.3 g lauroyl peroxide. When all the solids are dissolved, the two mixtures are combined and stirred for 5 minutes using a marine prop type agitator. This premix is passed through a Crepaco homogenizer operated at 5,000 psi and then heated to 67° C. overnight at 100 rpm stirring with a paddle type stirrer. The next day, the temperature is raised to 85° C. for 2 hours then cooled to room temperature. The polymer beads are purified by diafiltration using a 20K polysulfone membrane (Osmonics Corp) for three turnovers against distilled water. 2 g of a 0.7% Kathon LX solution (sold by Rohm and Haas) is added as a biocide per kg of slurry. The mean particle size is 2.81 microns as measured by a Microtrac Full Range Particle Analyzer.

Preparation 2

To 3272 g distilled water is added 34.3 g phthalic acid monopotassium salt, 13.4 g 0.1N hydrochloric acid, 44.3 g poly(N-methylaminoethanol-co-adipate) and 632.5 g of colloidal silica sold by DuPont under the trade designation Ludox TM. In a separate container is added 528 g vinyltoluene, 132 g divinylbenzene, 6.8 g hexadecane, 3.36 g Perkadox AMBN, an initiator sold by Akzo Chemical Co., and 10.16 g lauroyl peroxide. When all the solids are dissolved, the two mixtures are combined and stirred for 5 minutes using a marine prop type agitator. This premix is passed through a Crepaco homogenizer operated at 1,400 psi and then passed through again at 5,000 psi followed by heating to 67° C. overnight at 100 rpm stirring with a paddle type stirrer. The next day, the temperature is raised to 85° C. for 2 hours then cooled to room temperature. The polymer beads are purified by diafiltration using a 20K polysulfone membrane (Osmonics Corp) for three turnovers against distilled water. 2 g of a 0.7% Kathon LX solution (sold by Rohm and Haas) is added as a biocide per kg of slurry. The mean particle size is 0.78 microns as measured by a Microtrac Full Range Particle Analyzer.

Preparation 3

To 9162 g distilled water is added 96.1 g phthalic acid monopotassium salt, 37.7 g 0.1N hydrochloric acid, 113 g poly(N-methylaminoethanol-co-adipate) and 1610 g of colloidal silica sold by DuPont under the trade designation Ludox TM. In a separate container is added 4476 g vinyltoluene, 1120 g divinylbenzene, 56 g hexadecane, 8 g Perkadox AMBN, an initiator sold by Akzo Chemical Co., and 83.9 g lauroyl peroxide. When all the solids are dissolved, the two mixtures are combined and stirred for 5 minutes using a marine prop type agitator. This premix is passed through a Crepaco homogenizer operated at 5,000 psi and then heated to 67° C. overnight at 100 rpm stirring with a paddle type stirrer. The next day, the temperature is raised to 85° C. for 2 hours then cooled to room temperature. The polymer beads are purified by diafiltration using a 20K polysulfone membrane (Osmonics Corp) for three turnovers against distilled water. 2 g of a 0.7% Kathon LX solution (sold by Rohm and Haas) is added as a biocide per kg of slurry. The mean particle size is 1.60 microns as measured by a Microtrac Full Range Particle Analyzer.

Preparation 4

To 11,453 g distilled water is added 120 g phthalic acid monopotassium salt, 46.9 g 0.1N hydrochloric acid, 64.7 g poly(N-methylaminoethanol-co-adipate) and 924 g of colloidal silica sold by DuPont under the trade designation Ludox TM. In a separate container is added 1,848 g vinyltoluene, 462 g divinylbenzene, 23.8 g hexadecane, 11.8 g Perkadox AMBN, an initiator sold by Akzo Chemical Co., and 35.6 g lauroyl peroxide. When all the solids are dissolved, the two mixtures are combined and stirred for 5 minutes using a marine prop type agitator. This premix is passed through a Crepaco homogenizer operated at 5,000 psi and then heated to 67° C. overnight at 100 rpm stirring with a paddle type stirrer. The next day, the temperature is raised to 85° C. for 2 hours then cooled to room temperature. The polymer beads are purified by diafiltration using a 20K polysulfone membrane (Osmonics Corp) for three turnovers against distilled water. 2 g of a 0.7% Kathon LX solution (sold by Rohm and Haas) is added as a biocide per kg of slurry. The mean particle size is 1.45 microns as measured by a Microtrac Full Range Particle Analyzer.

Preparation 5

To 3272 g distilled water is added 34.3 g phthalic acid monopotassium salt, 13.4 g 0.1N hydrochloric acid, 40.25 g poly(N-methylaminoethanol-co-adipate) and 575 g of colloidal silica sold by DuPont under the trade designation Ludox TM. In a separate container is added 349 g vinyltoluene, 87 g divinylbenzene, 4.5 g hexadecane, 2.2 g Perkadox AMBN, an initiator sold by Akzo Chemical Co., and 6.7 g lauroyl peroxide. When all the solids are dissolved, the two mixtures are combined and stirred for 5 minutes using a marine prop type agitator. This premix is passed through a Crepaco homogenizer operated at 1,400 psi and then passed through again at 5,000 psi followed by heating to 67° C. overnight at 100 rpm stirring with a paddle type stirrer. The next day, the temperature is raised to 85° C. for 2 hours then cooled to room temperature. The polymer beads are purified by diafiltration using a 20K polysulfone membrane (Osmonics Corp) for three turnovers against distilled water. 2 g of a 0.7% Kathon LX solution (sold by Rohm and Haas) is added as a biocide per kg of slurry. The mean particle size is 0.58 microns as measured by a Microtrac Full Range Particle Analyzer.

Preparation 6

To 3320 g distilled water is added 31.9 g poly(N-methylaminoethanol-co-adipate) and 287.5 g of colloidal silica sold by DuPont under the trade designation Ludox TM. In a separate container is added 528 g vinyltoluene, 132 g divinylbenzene, 3.36 g Perkadox AMBN, an initiator sold by Akzo Chemical Co., and 10.16 g lauroyl peroxide. When all the solids are dissolved, the two mixtures are combined and stirred for 5 minutes using a marine prop type agitator. This premix is passed through a Crepaco homogenizer at 5,000 psi followed by heating to 67° C. overnight at 100 rpm stirring with a paddle type stirrer. The next day, the temperature is raised to 80° C. for 2 hours then cooled to room temperature. 2 g of a 0.7% Kathon LX solution (sold by Rohm and Haas) is added as a biocide per kg of slurry. The mean particle size is 0.89 microns as measured by a Microtrac Full Range Particle Analyzer.

Preparation 7

To 3320 g distilled water is added 24 g poly(N-methylaminoethanol-co-adipate) and 215 g of colloidal silica sold by DuPont under the trade designation Ludox TM. In a separate container is added 528 g vinyltoluene, 132 g divinylbenzene, 3.36 g Perkadox AMBN, an initiator sold by Akzo Chemical Co., and 10.16 g lauroyl peroxide. When all the solids are dissolved, the two mixtures are combined and stirred for 5 minutes using a marine prop type agitator. This premix is passed through a Crepaco homogenizer at 5,000 psi followed by heating to 67° C. overnight at 100 rpm stirring with a paddle type stirrer. The next day, the temperature is raised to 80° C. for 2 hours then cooled to room temperature. 2 g of a 0.7% Kathon LX solution (sold by Rohm and Haas) is added as a biocide per kg of slurry. The mean particle size is 1.2 microns as measured by a Microtrac Full Range Particle Analyzer.

Preparation 8

Polymethyl methacrylate matte made using lauroyl peroxide as the initiator and Aerosol TO-100 (sodium dioctyl sulfosuccinate sold by American Cyanamid) as the suspending agent is used as a control. Neither hexadecane nor a solid inorganic colloid are used in the preparation. The mean size as measured by a Microtrac Full Range Particle Analyzer is about 1.5 microns In the working examples which follow, thermally processable elements within the scope of the present invention were evaluated for image quality, process transport and blocking characteristics in accordance with the following test procedures.

Image Quality

Images in a photothermographic imaging layer are often viewed at magnifications of up to 100×. Large individual matte particles or agglomerations of smaller individual matte particles in the protective overcoat adjacent to the imaging layer or in the backing layer, when viewed at high magnifications, may result in partial or full obstruction of information in the imaging layer. Furthermore, these particles even if they do not obstruct information when viewing the photothermographic imaging element directly, may alter or obscure the images in next generation film or paper duplicates of the image.

Hence, practical evaluations are made to assess the ability of either single or agglomerated matte particles at typical viewing magnifications of 24 to 50× to obscure information in the photothermographic imaging element or either film or paper duplicates are made. An assessment is made as to how much if any of the information is lost, obscured or unidentifiable because of the particles. This evaluation may be a subjective rating from excellent representing no lost or obscuring of information, (rating of 0) to severe where information is lost or unidentifiable to the point that visual integration of surrounding area can not be used to render the lost part of the image. (rating of 5). Numeric ratings in Table II below use the 0–5 rating system for matte appearance evaluation.

Optical microscopy can be used to define matte appearance. The samples are imaged using reflected brightfield illumination at 1500× magnification. The IBAS image processing and analysis system is used to measure DCIRCLE, an estimate of the particle size distribution. Twenty fields are selected randomly for a total measurement area of 0.25 $mm^2$. Manual editing of the image can be done to remove information that was detected but was not matte related (e.g. scratches). Clusters of matte beads are not separated using manual editing or software separation algorithms. Often only beads greater than or equal to one micron are included in the analysis. DCIRCLE sample testing results are presented in Table I below.

Process Transport

An insufficiently large matte particle and/or an insufficient quantity of matte particles in the protective overcoat layer can result in transport problems with the photothermographic imaging element in the systems for which it was intended. A practical experiment is necessary to evaluate transport of the imaging element in a duplication system and observe transport problems due to blocking or sticking of the protective overcoat to either the backside protective overcoat of an adjacent portion of the photothermographic imaging element, the external surface of a duplicate media or the materials comprising the transport path of the photothermographic imaging element in the subsequent process.

A Gould Microtopographer 200, a raster scanning stylus method, serves as a practical test used to evaluate process transport for the matte examples and the results are presented in Table II below. The instrument is interfaced to a Hewlett Packard Computer System and is calibrated daily on National Institute of Standards and Technology (NIST) reference blocks. The examples of the invention referenced in Table II have acceptable roughness average (Ra) values and Average Peak Counts (Peaks/inch). $R_a$ (surface roughness) and peak count are common parameters for quantitating the surface of a matte-containing layer and hence indicating relative frictional properties.

Blocking Test

A more objective evaluation is performed by stacking the photothermographic imaging element with contacting sides being the protective overcoat layer of one piece and the protective backing layer of the adjacent piece. A 1000 gram weight is then placed in the stack and the stack is put in an environmentally controlled chamber at 27° C. and 80% RH for 7 days. The weight is then removed and the stack is evaluated for blocking or sticking of adjacent pieces of the imaging element. A qualitative ranking can be assigned to each imaging element tested as to the severity of the blocking. The resistance to blocking for an imaging element is dependent on the type, size and quantity of the matte as well as the hydrophilicity of the protective overcoat layer. Historical data show that protective overcoats with either an insufficient quantity of matte particles or with matte particles of insufficient size, will result in blocking of the imaging layer in this test. The examples of the invention referenced in Tables I and II had acceptable blocking.

The invention is further illustrated by the following examples of its practice.

A thermally processable imaging element was prepared using a 0.1 millimeter thick polyethylene terephthalate film, subbed on the non-imaging side only, as a support. The subbed polyethylene terephthalate film was coated on the subbed side with a backing layer having a dry thickness of 0.5 micrometers and on its opposite side, in order, with an imaging layer having a dry thickness of 7 micrometers and a protective overcoat layer having a dry thickness of 2 micrometers. The composition of the imaging layer was substantially the same as that described in Example 1 of U.S. Pat. No. 4,741,992.

Each of control elements 1 and 2 and each of the elements of Examples 1 and 2 comprised an electroconductive layer containing vanadium pentoxide underlying the backing layer. The backing layer was comprised of matte particles, consisting of a cross-linked copolymer of methyl methacrylate and ethylene glycol dimethacrylate, dispersed in a polymethylmethacrylate binder.

In control element 1, the protective overcoat layer comprised 700 mg/m$^2$ of polyvinyl alcohol, 1050 mg/m$^2$ of poly(silicic acid) and 100 mg/m$^2$ of polymethyl methacrylate beads prepared in the manner described in preparation 8 hereinabove. Control Element 2 was the same as Control Element 1 except that it contained 60 mg/m$^2$ of the polymethyl methacrylate beads. The element of Example 1 differed from control element 1 in that the polymethyl methacrylate beads were replaced with 60 mg/m$^2$ of polymeric matte particles prepared in the manner described in preparation 2 hereinabove. The element of Example 2 differed from control element 1 in that the polymethyl methacrylate beads were replaced with 100 mg/m$^2$ of polymeric matte particles prepared in the manner described in preparation 2 hereinabove. The results obtained for Control 1 and Examples 1 and 2 in the image quality test are summarized in Table I below.

TABLE I

| | DCIRCLE (in counts per channel) | | | |
|---|---|---|---|---|
| Example No. | 3 micrometers | 4 micrometers | 5 micrometers | 6 micrometers |
| Control 1 | 1083 | 609 | 290 | 120 |
| 1 | 153 | 38 | 18 | 6 |
| 2 | 152 | 49 | 23 | 7 |

As shown by the data in Table I, image quality was substantially better in both examples 1 and 2, which utilized polymeric matte particles having a polymeric core surrounded by a layer of colloidal silica particles, than in control element 1 in which the matte particles were polymethyl methacrylate beads.

Results obtained in the process transport test for Examples 1 and 2 and for control element 2 are summarized in Table II below. All surface topography data reported in Table II are the average of two sets of ten traces. The peak count refers to the number of peaks equal to or greater than the indicated minimum peak size in micrometers.

TABLE II

| | Matte Appearance | Surface Topography (peak count in peaks/inch) | | | | | | | |
|---|---|---|---|---|---|---|---|---|---|
| Example No. | Rating | $R_a$ | 0.076μ | 0.127μ | 0.254μ | 0.508μ | 0.752μ | 1.016μ | (Peak cut-off) |
| Control 2 | 3 | 2.85 | 1225.0 | 545.0 | 244.0 | 125.0 | 78.0 | 41.0 | |
| 1 | 0 | 2.07 | 1453.0 | 672.0 | 159.0 | 25.0 | 6.0 | 3.0 | |
| 2 | 1 | 2.47 | 2016.0 | 1153.0 | 309.0 | 45.0 | 9.0 | 4.0 | |

As indicated by the data in Table II, the peak count was significantly lower for the examples as compared to the control at the larger minimum peak sizes, indicating that the number of agglomerates was much less. The examples also demonstrate a substantial improvement in matte appearance as compared to the control.

A number of important benefits are obtained in thermally processable imaging elements by use therein of the polymeric matte particles of U.S. Pat. No. 5,378,577, such as, for example, improved characteristics with respect to image quality, matte adhesion, blocking, dusting, abrasion, lack of haze and the like. While the '577 patent describes the use of such polymeric matte particles and resulting improvement in adhesion in photographic light-sensitive elements intended to be wet processed, such as conventional photographic elements comprising one or more silver halide emulsion layers, it was unexpected to find that an actual improvement in image quality can be obtained when the polymeric matte particles of the '577 patent are used in thermally processable elements such as photothermographic elements.

The invention has been described in detail, with particular reference to certain preferred embodiments thereof, but it should be understood that variations and modifications can be effected within the spirit and scope of the invention.

We claim:

1. A thermally processable imaging element, said element comprising:

(1) a support;

(2) a thermographic or photothermographic imaging layer on one side of said support;

(3) a protective overcoat layer which is an outermost layer on the same side of said support as said imaging layer; and (4) a backing layer which is an outermost layer located on the side of said support opposite to said imaging layer;

wherein said thermally processable imaging element comprises polymeric matte particles in at least one layer thereof; said polymeric matte particles comprising a polymeric core surrounded by a layer of colloidal inorganic particles.

2. A thermally processable imaging element as claimed in claim 1, wherein said polymeric matte particles are present in said protective overcoat layer.

3. A thermally processable imaging element as claimed in claim 1, wherein said polymeric matte particles are present in said backing layer.

4. A thermally processable imaging element as claimed in claim 1, wherein said polymeric matte particles are present in both said protective overcoat layer and said backing layer.

5. A thermally processable imaging element as claimed in claim 1, wherein said support is a poly(ethylene terephthalate) film.

6. A thermally processable imaging element as claimed in claim 1, wherein said imaging layer comprises:

(a) photographic silver halide, (b) an image-forming combination comprising (i) an organic silver salt oxidizing agent, with (ii) a reducing agent for the organic silver salt oxidizing agent, and (c) a toning agent.

7. A thermally processable imaging element as claimed in claim 1, wherein said imaging layer comprises:

(a) photographic silver halide, (b) an image-forming combination comprising (i) silver behenate, with (ii) a phenolic reducing agent for the silver behenate, (c) a succinimide toning agent, and (d) an image stabilizer.

8. A thermally processable imaging element as claimed in claim 1, wherein said polymeric matte particles have a mean particle diameter in the range of from about 0.5 to about 5 micrometers.

9. A thermally processable imaging element as claimed in claim 1, wherein said polymeric matte particles have a mean particle diameter in the range of from about 0.5 to about 2 micrometers.

10. A thermally processable imaging element as claimed in claim 1, wherein said polymeric matte particles have a mean particle diameter in the range of from about 0.6 to about 1 micrometer.

11. A thermally processable imaging element as claimed in claim 1, wherein said polymeric matte particles are present therein in an amount of from about 10 to about 200 $mg/m^2$.

12. A thermally processable imaging element as claimed in claim 1, wherein said polymeric matte particles are present therein in an amount of from about 20 to about 70 $mg/m^2$.

13. A thermally processable imaging element is claimed in claim 1, wherein said colloidal inorganic particles are silica particles.

14. A thermally processable imaging element as claimed in claim 1, wherein said polymeric core is comprised of vinyl toluene crosslinked with divinylbenzene.

15. A thermally processable imaging element as claimed in claim 1, wherein said polymeric core is comprised of a crosslinked methyl methacrylate polymer.

16. A thermally processable imaging element as claimed in claim 1, wherein said polymeric core comprises a non-reactive hydrophobe.

17. A thermally processable imaging element as claimed in claim 1, wherein said polymeric core comprises hexadecane.

18. A thermally processable imaging element as claimed in claim 1, wherein said protective overcoat layer comprises poly(silicic acid).

19. A thermally processable imaging element as claimed in claim 1, wherein said protective overcoat layer comprises poly(silicic acid) and a water-soluble hydroxyl-containing monomer or polymer.

20. A thermally processable imaging element as claimed in claim 1, wherein said protective overcoat layer comprises poly(silicic acid) and poly(vinyl alcohol).

21. A thermally processable imaging element, said element comprising:

(1) a support;

(2) a photothermographic imaging layer on one side of said support; said photothermographic imaging layer comprising:

(a) photographic silver halide, (b) an image-forming combination comprising (i) an organic silver salt oxidizing agent, with (ii) a reducing agent for the organic silver salt oxidizing agent, and (c) a toning agent;

(3) a protective overcoat layer which is an outermost layer on the same side of said support as said photothermographic imaging layer; said protective overcoat layer containing poly(silicic acid) and polymeric matte particles comprising a polymeric core surrounded by a layer of colloidal inorganic particles; and (4) a backing layer which is an outermost layer located on the side of said support opposite to said imaging layer.

22. A thermally processable imaging element, said element comprising:

(1) a polyethylene terephthalate support, (2) a photothermographic imaging layer on one side of said support, said photothermographic imaging layer comprising:

(a) photographic silver halide, (b) an image-forming combination comprising (i) silver behenate, with (ii) a phenolic reducing agent for the silver behenate, (c) a succinimide toning agent, and (d) an image stabilizer;

(3) a protective overcoat layer which is an outermost layer on the same side of said support as said photothermographic imaging layer, said protective overcoat layer containing poly(silicic acid), poly(vinyl alcohol) and polymeric matte particles comprising a polymeric core surrounded by a layer of colloidal silica particles; and (4) a backing layer which is an outermost layer on the side of said support opposite to said imaging layer.

23. A thermally processable imaging element, said element comprising:

(1) a support;

(2) a thermographic or photographic imaging layer on one side of said support;

(3) a protective overcoat layer with is an outermost layer of the same side of said support as said imaging layer; and (4) a backing layer which is an outermost layer located on the side of said support opposite to said imaging layer;

wherein said thermally processable imaging element comprises both polymeric matte particles and poly(silicic acid) in at least one layer thereof; said polymeric matte particle comprising a polymeric core surrounded by a layer of colloidal silica particles.

* * * * *